United States Patent [19]

Van Benschoten et al.

[11] Patent Number: 4,856,972

[45] Date of Patent: Aug. 15, 1989

[54] DUAL ROLLER PERISTALTIC PUMP

[75] Inventors: Peter Van Benschoten, Rancho Santa Fe; David Burkett, San Diego, both of Calif.

[73] Assignee: Fisher Scientific Co., Pittsburgh, Pa.

[21] Appl. No.: 204,382

[22] Filed: Jun. 9, 1988

[51] Int. Cl.[4] ..... F04B 43/12

[52] U.S. Cl. ..... 417/477; 604/153

[58] Field of Search ..... 417/476, 477, 474, 475; 604/153

[56] References Cited

U.S. PATENT DOCUMENTS

| | | | |
|---|---|---|---|
| 1,922,196 | 8/1933 | Butler | 417/474 X |
| 2,412,397 | 12/1946 | Harper | 417/474 |
| 3,137,242 | 6/1964 | Hahn | 417/477 |
| 3,140,666 | 7/1964 | Currie | 417/477 |
| 3,610,781 | 10/1971 | Kolb | 417/319 |
| 3,737,251 | 6/1953 | Berman et al. | 417/12 |
| 3,756,752 | 9/1973 | Stenner | 417/477 |
| 3,778,195 | 12/1973 | Bamberg | 417/474 |
| 3,807,131 | 4/1974 | Samson | 417/476 X |
| 4,025,241 | 5/1977 | Clemens | 417/477 |
| 4,095,923 | 6/1978 | Cullis | 417/475 |
| 4,155,362 | 5/1979 | Jess | 128/214 F |
| 4,184,817 | 1/1980 | Pareja | 417/539 |
| 4,191,184 | 3/1980 | Carlisle | 128/214 F |
| 4,233,001 | 11/1980 | Schmid | 417/475 |
| 4,278,085 | 7/1981 | Shim | 128/214 F |
| 4,346,705 | 8/1982 | Pekkarinen et al. | 128/214 F |
| 4,380,236 | 4/1983 | Norton | 417/476 X |
| 4,394,862 | 7/1983 | Shim | 604/67 |
| 4,445,826 | 5/1984 | Tarr | 417/476 |
| 4,473,342 | 9/1984 | Iles | 417/360 |
| 4,487,604 | 12/1984 | Iwatschenko | 417/477 |
| 4,563,179 | 1/1986 | Sakai | 604/244 |
| 4,702,675 | 10/1987 | Aldrovandi et al. | 417/63 |

FOREIGN PATENT DOCUMENTS 60-230582 11/1985 Japan .

*Primary Examiner*—Leonard E. Smith

*Attorney, Agent, or Firm*—Nydegger & Harshman

[57] ABSTRACT

A peristaltic pump for infusing medical solutions to a patient through a flexible tube comprises a pair of counter-rotating drive shafts mounted on a base. A separate roller is eccentrically mounted on each of the drive shafts and each roller has a wheel which is slidingly suspended at its periphery. A pair of curvilinear platens are each separately disposed concentric with a respective drive shaft to engage the tube between the wheel on each roller and the platen. Cooperative counterrotation of the drive shafts cause each roller to sequentially squeeze the tube against its respective platen to create a moving zone of occlusion along the tube.

15 Claims, 4 Drawing Sheets

DUAL ROLLER PERISTALTIC PUMP

BACKGROUND OF THE INVENTION

This invention pertains generally to peristaltic pumps. More specifically, this invention pertains to eccentric roller peristaltic pumps which engage a fluid tube between the roller and a platen to establish a moving zone occlusion along the tube. This invention is particularly, but not exclusively, useful for the infusion of medical solutions to a patient.

DISCUSSION OF THE PRIOR ART

Peristaltic pumps, per se, are well known and have been used for a variety of purposes. In general, peristaltic pumps incorporate mechanisms which create a moving zone of occlusion along a tube or conduit which is effective for establishing a fluid flow through the tube or conduit. Inherently, the tube must have some degree of flexibility and the pump mechanism must urge against the tube in a controlled and predictable manner to create the moving zone of occlusion. This is common to all peristaltic pumps.

Basically, peristaltic pumps can be classified as either linear peristaltic pumps or rotary peristaltic pumps. An example of a linear peristaltic pump is found in the disclosure of U.S. Pat. No. 4,617,014 which issued to Cannon et al. for an invention entitled "Dual Mode IV Infusion Device" and which is assigned to the same assignee as the present invention. An example of a rotary peristaltic pump is found in the disclosure of U.S. Pat. No. 4,346,705 which issued to Pekkariner et al. for an invention entitled "Metering Apparatus Having Rate Compensation Circuit." The essential difference between linear and rotary peristaltic pumps, as evidenced by the above-cited references, is the manner in which the moving zone of occlusion is created. For this purpose, the linear peristaltic pump incorporates a plurality of fingers which each sequentially urge against their respective portions of the tube to create the moving zone of occlusion. On the other hand, the rotary peristaltic pump moves a roller, or some similar structure, along the tube to create the moving zone of occlusion. Under the above stated distinction, the present invention is to be generally classified as a rotary peristaltic pump.

In the medical device field where the purpose of a device is the infusion of medical solutions to patients, certain requirements are demanded and cannot be compromised. These include safety, accuracy, dependability, and reliability. Further, underlying these requirements is the desired objective that the generated fluid flow be as nonpulsitile as possible. Peristaltic pumps are generally able to satisfy most requirements. Not surprisingly, however, where the linear peristaltic pump has advantages, the rotary peristaltic pump does not, and vice versa. For example, while a linear peristaltic pump will typically generate a more uniform fluid flow than will a rotary peristaltic pump, a rotary peristaltic pump is structurally less complicated and easier to manufacture than a linear peristaltic pump.

The present invention seeks some middle ground. With this middle ground in mind, the present invention recognizes that the medical device requirements can be substantially met with a peristaltic pump which is far less complicated than the typical linear peristaltic pump and far more accurate than the typical rotary peristaltic pump. Specifically, the present invention recognizes that two eccentrically mounted counterrotating rollers can be juxtaposed in a manner which substantially minimizes pulsitile flow. Thus, the present invention benefits from an advantage normally associated with linear peristaltic pumps. Also, the present invention recognizes that such a mechanism can be simple and uncomplicated.

In light of the above, it is an object of the present invention to provide a peristaltic pump which generates a substantially uniform fluid flow. Another object of the present invention is to provide a peristaltic pump which is easily operated and reliable. Still another object of the present invention is to provide a peristaltic pump which is structurally uncomplicated and relatively easily repaired. Yet another object of the present invention is to provide a peristaltic pump which is relatively easily manufactured and cost effective.

SUMMARY OF THE INVENTION

A preferred embodiment of the novel dual roller peristaltic pump for pumping fluids through a flexible tube comprises a base on which a pair of counterrotating drive shafts are mounted substantially parallel to each other. A roller is eccentrically mounted on each drive shaft for rotation therewith and a wheel is slidingly suspended from the periphery of each roller. A pair of curvilinear platens are set on the base concentric with a respective drive shaft and are distanced therefrom to establish a slot between each roller-wheel and each respective platen into which the tube can be placed.

When placed on the pump in operative cooperation with the roller-wheels and platens, the tube assumes an S-shaped configuration. More specifically, the tube will loop halfway around the first roller-wheel in one direction and then loop halfway around the second roller-wheel in the opposite direction. The tube may comprise a first fitment which engages the tube to the base upstream from the first roller-wheel and a second fitment which engages to the base downstream from the second roller-wheel.

Operative counterrotation of the drive shafts is coordinated so that the first and second roller-wheels sequentially squeeze against the tube to create a moving zone of occlusion along the tube. The wheels can have textured surfaces which engage the tube with sufficient friction to prevent relative motion therebetween during operation of the dual roller peristaltic pump. At least one of the curvilinear platens can be moveably mounted on the base to be separated from the roller-wheel. In a first position, the platen is distanced from the roller-wheel to allow insertion of the tube therebetween. In a second position, the platen operatively urges against the tube to allow the roller-wheel to create a peristaltic action on the tube.

In an alternate embodiment of the present invention, the roller-wheels can be disposed in circular recesses formed on the base of the pump. In this alternate embodiment, the drive shafts are concentric with the recesses and the function of the separate curvilinear platens is assumed by the walls of the recesses.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
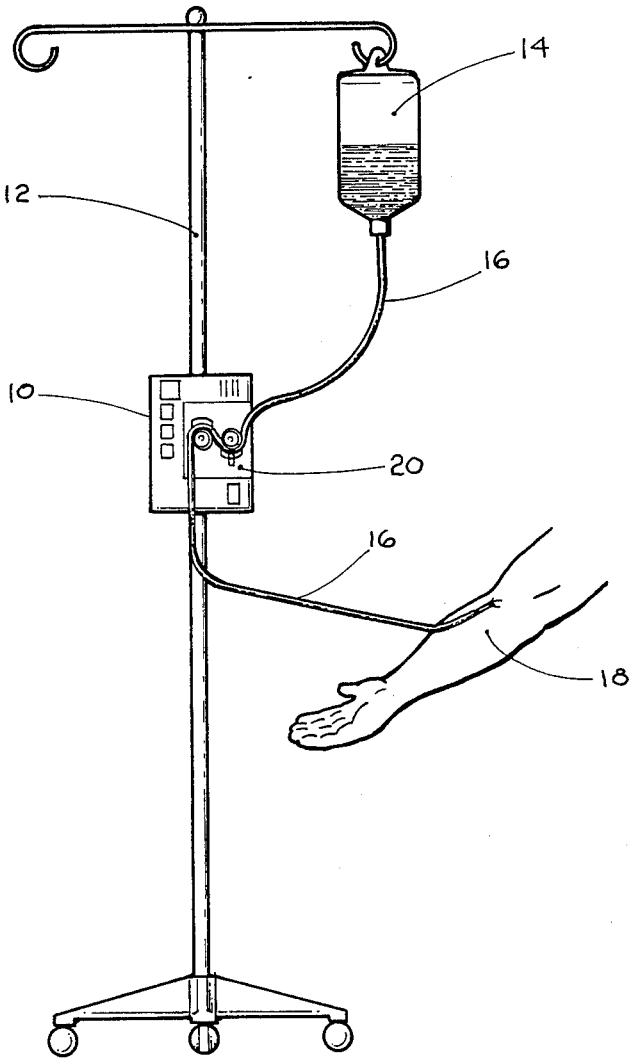
FIG. 1 is a front view of the dual roller peristaltic pump of the present invention in an operational environment.

Referring initially to FIG. 1, the dual roller peristaltic pump of the present invention is generally designated 10 and is shown in an operational environment. As shown in FIG. 1, pump 10 is clamped or otherwise attached to an IV pole 12. A fluid source 14 is suspended from pole 12 and is preferably positioned above pump 10. A flexible tube 16 is connected in fluid communication with fluid source 14 and is operatively connected with pump 10 in a manner to be subsequently discussed in detail. Preferably, flexible tube 16 is made of a medical grade plastic, such as polyvinyl chloride (PVC), and is selected for its compatibility with the particular medical solution being infused to patient 18 by pump 10. As shown in FIG. 1, flexible tube 16 proceeds from pump 10 to patient 18. The connection of flexbile tube 16 into fluid communication with patient 18 can be accomplished in any of several ways, all of which are well known in the pertinent art.

Figure 2:
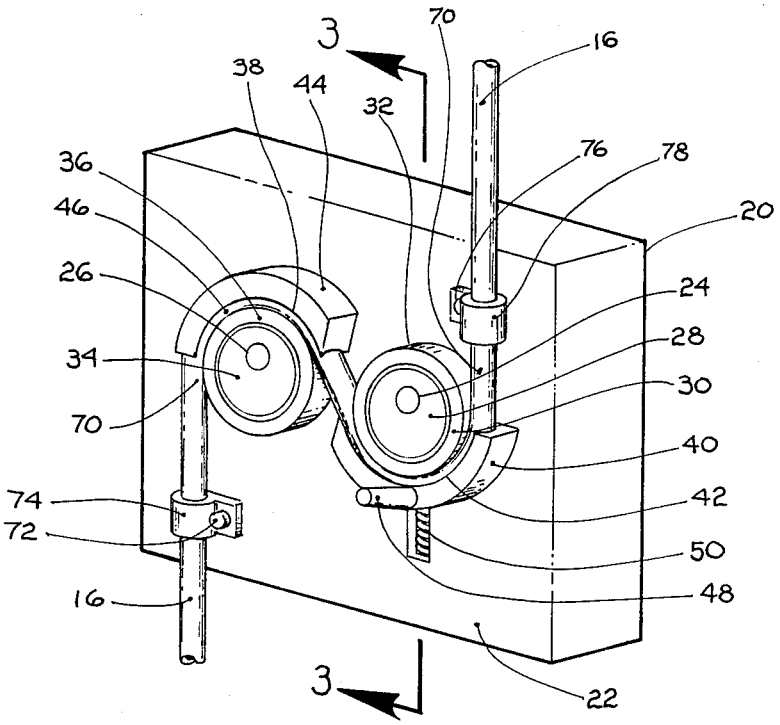
FIG. 2 is a front perspective view of the peristaltic mechanism of the present invention.

FIG. 2 shows the peristaltic mechanism, generally designated 20, separated from pump 10. As shown, peristaltic mechanism 20 comprises a base 22 on which a drive shaft 24 is rotatably mounted. A second drive shaft 26 is also mounted for rotation on base 22 and is positioned substantially parallel to the drive shaft 24. A circular roller 28 is eccentrically attached or mounted on drive shaft 24 in any manner well known in the art, such as by welding. An annular-shaped wheel 30 is slidingly suspended at the periphery of roller 28 to allow relative movement therebetween. The exposed peripheral surface 32 of wheel 30 may be textured or otherwise slightly roughened to create some frictional resistance between surface 32 of wheel 30 and the outside of flexible tube 16. Further, it is to be understood that surface 32 can be formed with indentations (not shown) or bumps (not shown) which may enhance the interaction of the roller-wheel combination with tube 16 according to the desires and needs of the operator.

According to the present invention, a circular roller 34 is eccentrically mounted on drive shaft 26 and an annular-shaped wheel 36 is slidingly suspended at the periphery of roller 34 to permit relative movement therebetween. In all important respects this roller-wheel combination is similar to the roller-wheel combination which is connected to drive shaft 24. Further, surface 38, like surface 32, can be textured or roughened to create frictional resistance between the surface 38 and the tube 16.

FIG. 2 also shows a curvilinear platen 40 which is mounted on base 22 concentrically with drive shaft 24. Specifically, platen 40 is operatively positioned relative to drive shaft 24 so that a portion of flexible tube 16 will fit within a slot 42 established between wheel 30 and platen 40. More specifically, platen 40 is positioned relative to wheel 30 so that as drive shaft 24 rotates, the distance across a given diameter of tube 16 between the surface 32 of wheel 30 and the platen 40 will vary. Specifically, this variation should be between an unsqueezed outer diametrical dimension for tube 16 and a squeezed outer diametrical dimension for tube 16. With this variation, each point on tube 16 between wheel 30 and platen 40 will experience cylical occlusions.

A curvilinear platen 44 is mounted on base 22 concentric to drive shaft 26 and positioned in a relationship with wheel 36 to establish a slot 46 therebetween into which tube 16 can be received. In all essential measurements, the relationship between platen 44, wheel 36 and tube 16 is the same as disclosed above for the relationship between platen 40, wheel 30 and tube 16.

Figure 3:
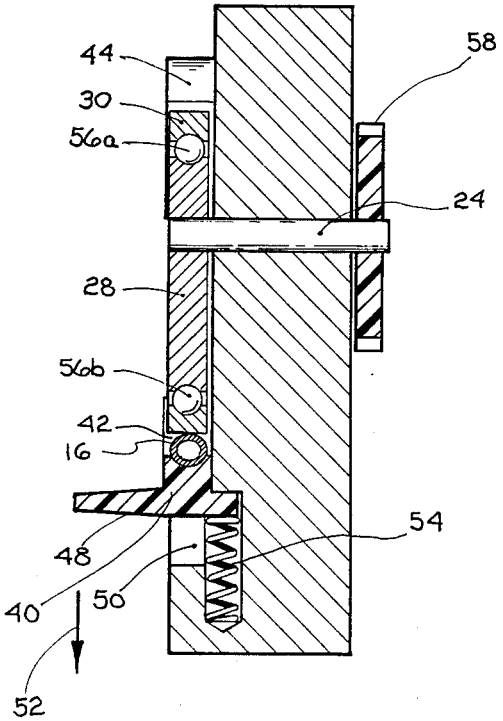
FIG. 3 is a side cross-sectional view of the peristaltic mechanism as seen along the line 3—3 in FIG. 2.

As best seen in FIG. 3, platen 40 is moveable relative to drive shaft 24 in a manner which will increase the width of slot 42. It should be noted at this point, however, that various structures for moving platen 40 are well known in the pertinent art. The following disclosure for this structure is only exemplary. Further, although the structure herein disclosed pertains only to platen 40, it is to be understood that similar structure can be incorporated for platen 44. In FIG. 3, platen 40 is shown formed with a handle 48 which can be manipulated to move platen 40 along guide groove 50. Specifically, movement of handle 48 in the direction of arrow 52 will cause a compression of spring 54 and allow platen 40 to be distanced from drive shaft 24 to widen slot 42. The release of handle 48 will cause platen 40 to return to the position as shown in FIG. 3 for operative contact with flexible tube 16. It will be understood that spring 54 must be of sufficient strength to urge the platen toward wheel 30 with sufficient force to effectively squeeze tube 16 between platen 40 and wheel 30. On the other hand, spring 54 can be sufficiently resilient to relieve excess forces which might build up between platen 40 and wheel 30.

In accordance with previous disclosure, wheel 30 is slidingly suspended on the periphery of roller 28. An example of structure which can accomplish this engaged relationship is shown in FIG. 3. There, it will be seen that a plurality of balls, of which balls 56*a* and 56*b* are exemplary, are positioned between roller 28 and wheel 30 in a manner well known to the skilled artisan. Wheel 30 is then freely suspended on the periphery of roller 28 and easily moved relative thereto. It is to be noted that wheel 36 can be similarly suspended around the periphery of roller 34.

Figure 4:
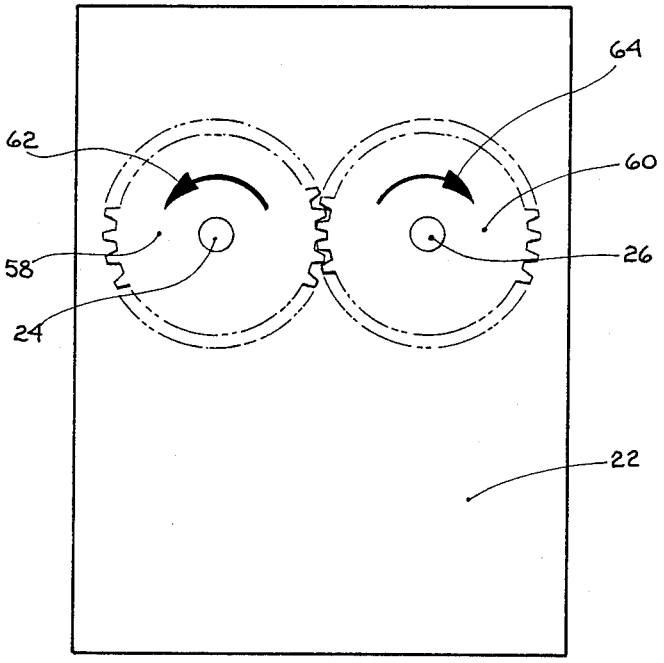
FIG. 4 is a back view of the peristaltic mechanism.

In FIG. 4, it can be seen that a spur gear 58 is fixed to the rear end of drive shaft 24. A quick cross-reference to FIG. 3 shows that spur gear 58 is mounted on drive shaft 24 for rotation therewith. As also shown in FIG. 4, a spur gear 60 is fixed to the rear end of drive shaft 26 and is placed in meshed engagement with spur gear 58. With this engagement, drive shafts 24 and 26 will counterrotate with respect to each other. Accordingly, rotation of drive shaft 24 in the direction of arrow 62 will cause drive shaft 26 to rotate in the direction of arrow 64. Further, if drive shaft 24 is rotated, drive shaft 26 must rotate and vice versa. Thus, the operator may engage a motor (not shown) with either drive shaft 24 or 26 to operate pump 10.

Figures 5A, 5B, 5C, 5D:
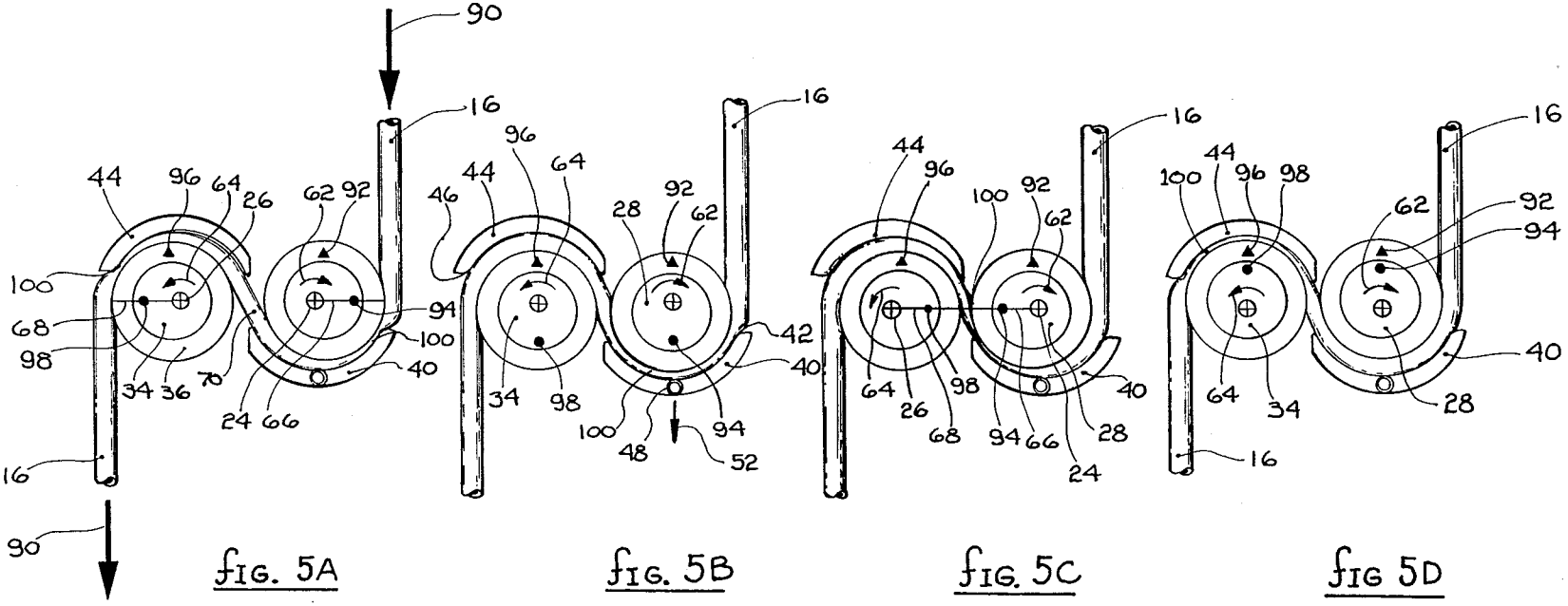
FIGS. 5A, 5B, 5C and 5D are front views of the peristaltic mechanism in sequentially operative configurations.

The geometry of components for peristaltic mechanism 20 will perhaps be best appreciated by reference to FIG. 5A. There, from an end on view of drive shafts 24 and 26, it is clearly seen that they are disposed substantially parallel to each other. As shown in FIG. 5A, roller 28 is fixed to drive shaft 24 with its line 66 of greatest or longest eccentricity on the side of drive shaft 24 which is directly opposite and away from the direction at which drive shaft 26 is positioned relative to drive shaft 24. Importantly, with line 66 so positioned, the line 68 of greatest or longest eccentricity for roller 34 is to the side of drive shaft 26 which is directly opposite and away from the direction at which drive shaft 24 is positioned relative to drive shaft 26. Several consequences result from this relationship. Recall that drive shafts 24 and 26 counterrotate. Thus, as will be subsequently discussed in greater detail, each complete rotation of drive shafts 24 and 26 causes the progression of configurations shown sequentially in FIGS. 5A, 5B, 5C and 5D.

In accordance with the present invention, the percentage of diameter of rollers 28 and 34 which is represented by lines 66 and 68 will be the same for each. Within this limitation, the actual range of percentage values for lines 66 and 68 will preferably be between 55% and 65%. Regardless, the percentage should be such that at the point on platen 40 which is on an extended line 66 of greatest eccentricity, the distance between wheel 30 and platen 40 will be at a minimum. Preferably, this minimum will just equal the dimension necessary to create a complete occlusion on tube 16. On the other hand, the eccentricity of roller 28 should be such that for the portion of roller 28 which is on the opposite side of drive shaft 24 from line 66, the distance between wheel 30 and platen 40 does not cause squeezing of tube 16 therebetween. This same configuration applies for the disclosure pertaining to roller 34, wheel 36 and platen 44. Further, as best seen in FIG. 5C, drive shaft 24 should be distanced from drive shaft 26 such that when their maximum eccentricities, i.e. lines 66 and 68, are diametrically opposed on tube 16, the tube 16 will experience an occlusion at that point. Accordingly, it will be appreciated that the diameter of roller 28 and 34, the thickness of wheels 30 and 36,the occluded dimension of tube 16 and the eccentricity of rollers 28 and 34 on respective drive shafts 24 and 26 will determine the distance at which drive shafts 24 and 26 are separated from each other on base 22.

Returning for the moment to FIG. 2, it will be seen that tube 16 can comprise a pumping section 70. This section 70 is preferably made of a "peristaltic grade" PVC well known to the skilled artisan and will be of sufficient length to assume an S-shaped configuration on peristaltic mechanism 20. More specifically, section 70 will loop halfway around roller 28 between wheel 30 and platen 40 and then loop halfway around roller 34 in the opposite direction between wheel 36 and platen 44. As also shown in FIG. 2, section 70 has a fitment 72 at one end thereof which is engageable with a clip 74 to help hold section 70 and tube 16 on base 22. Another fitment 76 is provided at the other end of pumping section 70 which is engageable with a clip 78 to hold section 70 and tube 16 on base 22.

Figure 6:
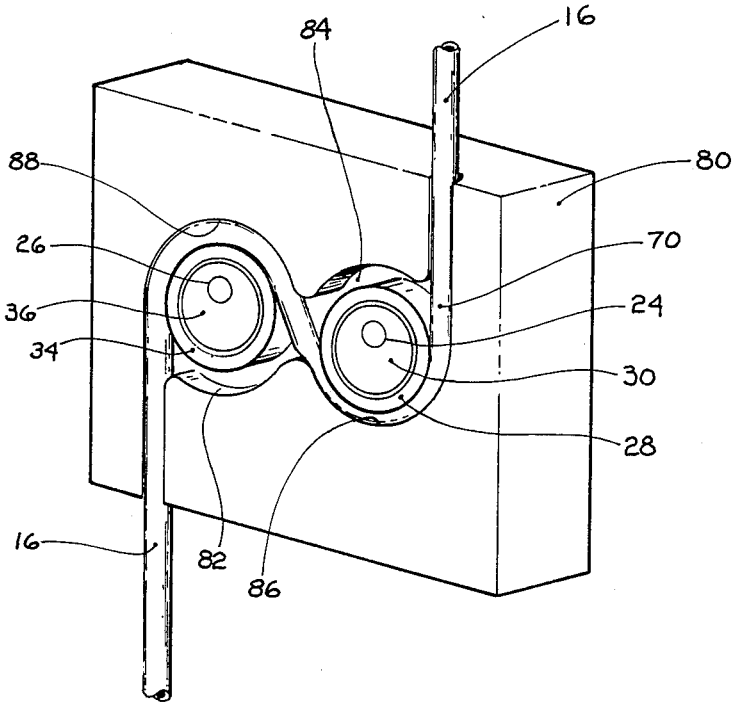
FIG. 6 is a front perspective view of an alternate embodiment of the dual roller peristaltic pump.

In an alternate embodiment of the dual roller peristaltic pump 10, as shown in FIG. 6, a base 80 is formed with circular depressions 82 and 84. Depressions 82 and 84 respectively establish curvilinear walls 86 and 88 against which pumping section 70 of tube 16 can be urged to create a moving zone of occlusion therealong. As will be easily appreciated, walls 86 and 88 provide replacement structure for platens 40 and 44. Further, drive shaft 24 is concentrically positioned in depression 82 and drive shaft 26 is concentrically positioned in depression 84. Roller 28 is eccentrically mounted on drive shaft 24 and roller 34 is eccentrically mounted on drive shaft 26. In all other essential respects, the alternate embodiment of pump 10 functions as previously disclosed for the preferred embodiment.

OPERATION

In its operation, the pump 10 is positioned relative to patient 18 as desired by the operator. Flexible tube 16 is placed into fluid communication with fluid source 14 and then operatively connected with pump 10 prior to placing the tube 16 into fluid communication with patient 18.

Engagement of tube 16 with peristaltic mechanism 20 is accomplished by manipulating handle 48 in a manner to move platen 40 away from roller 28 in the direction indicated by arrow 52. With rollers 28 and 34 positioned as shown in FIG. 5B, this movement of platen 40 causes both slots 42 and 46 to be sufficiently opened to allow placement of the pumping section 70 of tube 16 between roller 28 and platen 40 and between roller 34 and platen 44. Handle 48 can then be released to urge platen 40 against tube 16.

Recall that drive shafts 24 and 26 counterrotate. As shown in FIGS. 5A, 5B, 5C and 5D, the rotation of drive shafts 24 and 26 by a motor (not shown) in the respective directions indicated by arrows 62 and 64 will cause fluid to be pumped through tube 16 in the direction indicated by arrows 90. A more complete appreciation of the peristaltic motion created by pump 10 will be had by considering the positions of rollers 28 and 34 and the positions of wheels 30 and 36 during the counterrotation of drive shafts 24 and 26. This consideration will be simplified by following diamond mark 92 on wheel 30, dot mark 94 on roller 28, diamond mark 96 on wheel 36 and dot mark 98 on roller 34.

It is important to note that dots 94 and 98 are correspondingly placed on lines 66 and 68 which respectively indicate the longest line of eccentricity for rollers 28 and 34. The location of dots 94 and 98, of course, indicates that point on pumping section 70 of tube 16 which is experiencing a complete occlusion. It is also important to note that diamonds 92 and 96 remain stationary. Thus, wheels 30 and 36 also remain relatively stationary. Accordingly, tube 16 experiences forces which are substantially perpendicular to the platen 40 or 44 and which are diametrically directed against tube 16. This is so to reduce lateral forces on tube 16 and insure a more uniform peristaltic action.

To sequentially consider FIGS. 5A, 5B, 5C and 5D, it is noted that in FIG. 5A an occlusion 100 is just beginning between roller 28 and platen 40 and just ending between roller 34 and platen 44. FIG. 5B indicates that for approximately the first 180 degrees of rotation for drive shafts 24 and 26, the occlusion 100 is formed between roller 28 and platen 40, while tube 16 between roller 34 and platen 44 is patent. In FIG. 5C, the condition is shown wherein occlusion 100 is formed directly between roller 28 and roller 34. FIG. 5D shows the next phase in the peristaltic pumping action wherein the occlusion 100 is formed between roller 34 and platen 44 while the section of tube 16 between roller 28 and platen 40 is patent.

It will be appreciated by the skilled artisan that in accordance with the sequence just described, fluid will be pumped from fluid source 14 to patient 18 by the pump 10 of the present invention.

While the particular dual roller peristaltic pump as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. A peristaltic pump for pumping fluids through a flexible tube comprising:

a base;

a first drive shaft rotatably mounted on said base;

a second drive shaft mounted on said base substantially parallel to said first drive shaft for counterrotation with respect thereto;

a first curvilinear platen mounted on said base concentric with said first drive shaft;

a second curvilinear platen mounted on said base concentric to said second drive shaft;

a first roller eccentrically mounted on said first drive shaft for rotation therewith and positioned to create a slot between said first roller and said first platen to receive said tube therein for progressively squeezing said tube against said first platen; and a second roller eccentrically mounted on said second drive shaft for rotation therewith and positioned to create a slot between said second roller and said second platen to receive said tube therein for progressively squeezing said tube against said second platen.

2. A pump as recited in claim 1 wherein said first roller is positioned upstream from said second roller and said first and second rollers are respectively mounted on said first drive shaft and said second drive shaft for sequentially squeezing said tube to create a moving zone of occlusion therealong.

3. A pump as recited in claim 2 further comprising:

a first wheel surroundingly and slidably mounted on said first roller and disposed between said first roller and said tube; and a second wheel surroundingly and slidably mounted on said second roller and disposed between said second roller and said tube.

4. A pump as recited in claim 3 wherein said first and second wheels have textured surfaces to prevent relative slippage between said wheels and said tube.

5. A pump as recited in claim 4 wherein said tube further comprises a first fitment engageable with said base upstream from said first roller and a second fitment engageable with said base downstream from said second roller.

6. A pump as recited in claim 5 wherein said first platen is moveable relative to said first roller between a first position wherein said first roller squeezably urges said tube against said platen and a second position wherein said platen is distanced from said first roller to prevent squeezing said tube therebetween.

7. A pump as recited in claim 6 further comprising:

a first spur gear concentrically mounted on said first drive shaft;

a second spur gear concentrically mounted on said second drive shaft to meshingly engage said second spur gear with said first spur gear; and means for rotating said first drive shaft.

8. A peristaltic pump for pumping fluids through a flexible tube comprising:

a base formed with a first circular depression having a wall and a second circular depression having a wall;

a first drive shaft and a second drive shaft each rotatably mounted on said base concentrically in said respective first and second depressions; and a first roller and a second roller each eccentrically mounted on said respective first and second drive shafts for rotation therewith to squeeze said tube between said rollers and said walls and create a moving zone of occlusion therealong.

9. A pump as recited in claim 8 wherein said first and second depressions are juxtaposed.

10. A pump as recited in claim 9 wherein said first drive shaft counterrotates with respect to said second drive shaft.

11. A pump as recited in claim 9 wherein said first roller is positioned upstream from said second roller and said first and second rollers are respectively mounted on said first drive shaft and said second drive shaft for sequentially squeezing said tube to create a moving zone of occlusion therealong.

12. A pump as recited in claim 11 further comprising:

a first wheel surroundingly and slidably mounted on said first roller and disposed between said first roller and said tube; and a second wheel surroundingly and slidably mounted on said second roller and disposed between said second roller and said tube.

13. A pump as recited in claim 12 wherein said first and second wheels have textured surfaces to prevent relative slippage between said wheels and said tube.

14. A pump as recited in claim 13 wherein said tube further comprises a first fitment engageable with said base upstream from said first roller and a second fitment engageable with said base downstream from said second roller.

15. A pump as recited in claim 14 further comprising:

a first spur gear concentrically mounted on said first drive shaft;

a second spur gear concentrically mounted on said second drive shaft to meshingly engage said second spur gear with said first spur gear; and means for rotating said first drive shaft.

* * * * *